US005234574A

United States Patent [19]

Tsuji et al.

[11] Patent Number: 5,234,574

[45] Date of Patent: Aug. 10, 1993

[54] PROCESS FOR DIRECT ZINC ELECTROPLATING OF ALUMINUM STRIP

[75] Inventors: Masanori Tsuji; Kazuyuki Fujita, both of Wakayama; Yoshihiko Hoboh, Osaka; Hiroshi Oishi; Naotaka Ueda, both of Wakayama, all of Japan

[73] Assignee: Sumitomo Metal Industries, Ltd., Osaka, Japan

[21] Appl. No.: 827,597

[22] Filed: Jan. 29, 1992

[30] Foreign Application Priority Data

Jan. 30, 1991 [JP] Japan ..... 3-009864

[51] Int. Cl.[5] ..... C25D 3/56; C25D 5/44

[52] U.S. Cl. ..... 205/213; 205/214; 205/244; 205/245

[58] Field of Search ..... 205/213, 214, 177, 176, 205/245, 246, 244

[56] References Cited

U.S. PATENT DOCUMENTS

| | | | |
|---|---|---|---|
| 3,098,804 | 7/1963 | Wittrock | 204/28 |
| 3,359,189 | 12/1967 | Cooke et al. | 204/28 |
| 3,915,811 | 10/1975 | Tremmel et al. | 204/33 |
| 4,097,342 | 6/1978 | Cooke et al. | 204/28 |
| 4,169,770 | 10/1979 | Cooke et al. | 205/213 |
| 4,437,944 | 3/1984 | Bruno et al. | 204/28 |
| 4,495,008 | 1/1985 | Bruno et al. | 148/31.5 |
| 4,681,668 | 7/1987 | Davies et al. | 204/28 |
| 4,969,980 | 11/1990 | Yoshioke et al. | 205/246 |
| 4,975,337 | 12/1990 | Hyner et al. | 205/177 |
| 5,015,340 | 5/1991 | Colombier et al. | 204/28 |

FOREIGN PATENT DOCUMENTS

| | | |
|---|---|---|
| 57-20399 | 4/1982 | Japan . |
| 61-157693 | 7/1986 | Japan . |
| 290903 | 5/1928 | United Kingdom . |

*Primary Examiner*—John Niebling
*Assistant Examiner*—Brian M. Bolam
*Attorney, Agent, or Firm*—Burns, Doane, Swecker & Mathis

[57] ABSTRACT

A process for direct zinc electroplating of aluminum strip which can be performed continuously at a high speed and a high current density. The process comprises pretreating aluminum strip by alkaline degreasing and then pickling and subjecting the pretreated aluminum strip to zinc electroplating in an acidic zinc plating bath which contains, in addition to $Zn^{2+}$ ions, metal ions selected from the group consisting of $Ni^{2+}$ ions and $Fe^{2+}$ ions in a concentration of at least about 10 g/l to form a Zn-Ni, Zn-Fe, or Zn-Ni-Fe alloy plated coating, which may be overlaid with another zinc electroplated coating.

14 Claims, No Drawings

PROCESS FOR DIRECT ZINC ELECTROPLATING OF ALUMINUM STRIP

BACKGROUND OF THE INVENTION

This invention relates to a process for direct zinc electroplating of aluminum strip. More particularly, it is concerned with a process for preparing zinc- or zinc alloy-plated aluminum strip suitable for use in the manufacture of automobile bodies by continuous direct electroplating at a high speed.

Aluminum sheet has begun to be employed in automobile bodies for the purposes of saving weight and thereby reducing fuel consumption. It is known that aluminum sheet which has been plated with zinc or a zinc alloy is suitable for use in such applications, since chemical conversion treatment such as phosphating or chromating can be easily performed on such plated aluminum sheet prior to finish paint coating. See Japanese Patent Application Laid-Open (Kokai) No 61-157693 (1986).

Aluminum and its alloys have high surface activity and form on the surface thereof a firm oxide film which is readily regenerated after removal. The presence of such an oxide film on the surface significantly inhibits the adhesion of a plated coating formed thereon. Therefore, when aluminum strip is electroplated, it has been considered necessary in the prior art to subject the aluminum strip to special pretreatment in order to remove the oxide film prior to electroplating.

For this purpose, displacement plating (also called immersion plating) with zinc or a zinc alloy is widely employed. This pretreatment method comprises forming a thin layer of zinc or a zinc alloy such as a Zn-Ni, Zn-Cu, or Zn-Fe alloy on the surface of aluminum strip (which is made of aluminum or an aluminum alloy) by means of displacement plating before the desired zinc electroplating is performed. The pretreatment method is performed by a process comprising the following steps, for example:

Degreasing with an organic solvent→Alkaline degreasing →Rinsing→Etching→Rinsing→Acid dipping→Rinsing →First Zn or Zn alloy displacement plating→Rinsing→Acid dipping→Rinsing→Second Zn or Zn alloy displacement plating→Rinsing→Strike Co or Ni plating.

The Zn or Zn alloy displacement plating is performed by immersing aluminum strip in a plating bath. Examples of compositions of useful plating baths and the immersion conditions are as follows:

(1) 120 g/l of sodium hydroxide, 20 g/l of zinc oxide, 2 g/l of crystalline ferric chloride, 50 g/l of Rochelle salt, and 1 g/l of sodium nitrate, 21°-24° C., immersion period of 30 seconds.

(2) 120 g/l of sodium hydroxide, 20 g/l of zinc oxide, 1-2 g/l of nickel cyanide, and 1 g/l of cuprous cyanide, 27°-30° C., immersion period of 20-60 seconds.

(3) 500 g/l of sodium hydroxide, 100 g/l of zinc oxide, 1 g/l of crystalline ferric chloride, and 10 g/l of Rochelle salt, 16°-27° C., immersion period of 30-60 seconds.

Pretreatment of aluminum strip by such a displacement plating method involves the following problems.

(a) The displacement plating is performed twice, leading to an increased number of steps. Furthermore, the Zn or Zn alloy plated coating formed by the first displacement plating is dissolved out into an acid in the subsequent acid dipping step prior to the second displacement plating. Therefore, it is a waste of resources and increases the costs required for waste water treatment.

(b) The plating bath used in each displacement plating is an alkaline bath containing a toxic substance such as a cyanide or Rochelle salt and requires more complicated bath control than an acidic plating bath such as a sulfate bath.

(c) It takes a relatively long period of 20-60 seconds to complete the desired displacement in each displacement plating step. As a result, an overall treating period of from about 3 minutes to about 13 minutes is required to proceed from the solvent degreasing step to the second displacement plating step. Therefore, the pretreatment method significantly interferes with the production efficiency.

Consequently, when zinc electroplating is applied to aluminum strip in a continuous plating line in which the aluminum strip is pretreated by the above-described method prior to the desired electroplating, it is impossible to attain a high line speed and a high efficiency as realized in a similar continuous electroplating line for steel strip. If a continuous electroplating line for aluminum strip having a line speed as high as that employed in electroplating of steel strip is constructed, it will have a line length which is several times as long as the length of an electroplating line for steel strip.

Accordingly, there is a need for a direct zinc electroplating method of aluminum strip which eliminates the pretreatment procedure comprising displacement plating.

Japanese Patent Publication No. 57-20399(1982) discloses a process for electroplating aluminum strip which comprises immersing aluminum strip in an alkaline solution or a hydrofluoric acid-containing acidic solution and then treating it in a mixed acid to roughen the surface of the strip before the strip is electroplated. According to that process, the oxide film formed in the surface of the aluminum strip is removed by immersing the strip in the alkaline or acidic solution and the surface is then roughened by dissolution with the mixed acid in order to assure good adhesion of a plated coating formed in the subsequent electroplating step to the aluminum strip substrate.

Also in that process, it takes a long pretreatment period of 55-165 seconds to remove the surface oxide film and roughen the surface. Therefore, the process is not suitable for continuous plating at a high speed since it requires a long plating line. In an example in that Japanese Patent Publication, aluminum strip is electroplated with zinc using a borofluoride bath. However, the current density employed in that example is very low, i.e., on the order of 6 A/dm$^2$. Accordingly, although the process is a kind of direct plating, it does not provide a high-speed, continuous plating process.

SUMMARY OF THE INVENTION

It is an object of this invention to enable a high-speed, continuous electroplating technique, which is already established for electroplating of steel strip, to be performed on aluminum strip.

Another object of the invention is to overcome the major problem in direct electroplating of aluminum strip and provide an electroplated coating having good adhesion to the aluminum strip.

A more specific object of the invention is to provide a process for direct zinc electroplating of aluminum strip which is capable of forming an electroplated coating having improved adhesion to the aluminum strip substrate by high-speed continuous plating.

As a result of experiments which were performed by applying a typical zinc electroplating process employed in a continuous electroplating line for steel strip to aluminum strip in order to investigate the effects of process conditions in pretreatment and electroplating steps on adhesion of the resulting zinc plated coating to the aluminum strip, it was found that the electroplating conditions have much greater effects on the plating adhesion than the pretreatment conditions which were considered to be important in the prior art batchwise electroplating of aluminum strip.

The present invention resides in a process for direct zinc electroplating of aluminum strip, comprising pretreating aluminum strip by alkaline degreasing and then pickling and subjecting the pretreated aluminum strip to zinc electroplating in an acidic zinc plating bath which contains, in addition to $Zn^{2+}$ ions, metal ions selected from the group consisting of $Ni^{2+}$ ions and $Fe^{2+}$ ions in a concentration of at least about 10 g/l.

The surface composition of the resulting zinc plated coating can be modified by applying a second zinc electroplating using a separate zinc plating bath to form an upper plated coating having a composition desired for the surface and different from the lower, first plated coating.

The term "aluminum strip" used herein encompasses strip of pure aluminum metal and strip of an aluminum alloy such as Al-Mg, Al-Mg-Si, Al-Cu, or the like which has an Al content of at least 50% by weight. The aluminum strip may be either in a coiled form or a sheet form.

Similarly, the terms "zinc electroplating", "zinc plating", and "zinc plated coating" used herein refers to electroplating or electroplated coating with either zinc or a zinc alloy.

DESCRIPTION OF THE INVENTION

As described above, the present inventors performed experiments by applying zinc electroplating to aluminum strip according to a continuous zinc electroplating process commonly employed for steel strip to investigate the effects of process conditions in each pretreatment procedure and electroplating.

A typical continuous zinc electroplating line for steel strip comprises the steps of alkaline degreasing, rinsing (water washing), pickling, rinsing, and zinc electroplating. The pretreatment and plating steps are generally performed under the following conditions:

(1) Alkaline degreasing: mainly conducted electrolytically using an aqueous about 3–7 wt % solution of sodium orthosilicate ($Na_4SiO_4$) or sodium hydroxide (NaOH), bath length of about 6–12m, treating period of about 3–6 seconds;

(2) Rinsing;

(3) Pickling: mainly conducted by dipping but sometimes by electrolytically using a sulfuric acid solution in most cases or a hydrochloric acid solution in some cases in a concentration of about 6–10 wt %, bath length of about 5–12m, treating period of about 2–10 seconds;

(4) Rinsing;

(5) Zinc electroplating: using a sulfate or chloride bath, current density of about 30–150 A/dm$^2$.

In a first experiment, zinc electroplating was applied to an aluminum alloy (Al-4.5 Mg alloy) while the conditions for pretreatment, i.e., alkaline degreasing and pickling were widely varied in order to investigate the effects of these conditions on adhesion of the resulting plating. In this experiment, the electroplating was performed at a current density of 50 A/dm$^2$ using a zinc sulfate bath containing 90 g/l of $Zn^{2+}$ (pH 1.8) and maintained at a temperature of 55° C. to give a constant plated coating weight of 20 g/m$^2$.

The adhesion of the resulting zinc plated coating to the aluminum alloy substrate was measured by an Erichsen cupping test which was performed by subjecting a lattice pattern-cut test piece to Erichsen punch stretch to a depth of 7 mm. The punch-stretched portion was subjected to a pressure-sensitive adhesive tape peeling test and the adhesion was evaluated as follows based on the percent retention of plated coating remaining on the substrate after the tape peeling.

| Rating | % Retention |
|---|---|
| 1 (Excellent) | 100 |
| 2 (Good) | 95-99 |
| 3 (Moderate) | 90-94 |
| 4 (Poor) | 50-89 |
| 5 (Very Poor) | 0-49 |

A rating of 1 or 2 is satisfactory since the plating adhesion is substantially improved.

The test results are shown in Table 1, from which it can be seen that the plating adhesion was very poor (=Rating 5) in all the runs which were varied with respect to pretreatment conditions.

In a second experiment, the pretreatment conditions were fixed at those conditions used in Run No. 3 of Table 1 while the plating conditions were varied widely in order to determine the plating conditions sufficient to form a plated coating having good adhesion. The coating weight was constant at 20 g/m$^2$ and a sulfate or chloride plating bath was used. To some sulfate or chloride baths were added $Ni^{2+}$ or $Fe^{2+}$ ions so as to form a zinc alloy plated coating. The plating adhesion was evaluated in the same manner as described above. The results are shown in Table 2 below. In the case of pure zinc plating, the adhesion was not improved (remained at Rating 5) in all the runs conducted under varying plating conditions irrespective of whether the plating bath used was a sulfate or chloride bath. In contrast, each of the Zn-Ni and Zn-Fe alloy plated coatings exhibited excellent adhesion and was assigned Rating 1.

A further experiment was conducted to determine the effect on plating adhesion of addition of $Ni^{2+}$ or $Fe^{2+}$ ions to a plating bath. The plating conditions were those conditions used in Run No. 5 of Table 2 expect that $Ni^{2+}$ or $Fe^{2+}$ ions were added to the plating bath in varying amounts. The coating weight was constant at 20 g/m$^2$. The results attained by addition of $Ni^{2+}$ ions and $Fe^{2+}$ ions are shown in Tables 3 and 4, respectively. It can be seen that an electroplated coating having satisfactory adhesion of Rating 1 or 2 can be formed by addition of $Ni^{2+}$ or $Fe^{2+}$ ions in different amounts and that the amount of $Ni^{2+}$ or $Fe^{2+}$ ions to be added can be varied over a wide range to form a plated coating having good adhesion.

TABLE 1

Effect of Pretreatment Conditions on Plating Adhesion

| Run No. | Conditions for Alkali Degreasing Agent | Conc. | Temp. | Period | Conditions for Pickling Agent | Conc. | Temp. | Period | Plating Adhesion (Rating) |
|---|---|---|---|---|---|---|---|---|---|
| 1 | $Na_4SiO_4$ | 3% | 80° C. | 3 s | $H_2SO_4$ | 3% | 80° C. | 2 s | 5 |
| 2 | | " | " | " | HCl | " | " | " | " |
| 3 | | 7% | " | 6 s | " | 8% | " | 5 s | " |
| 4 | | 15% | " | 3 s | " | " | " | " | " |
| 5 | | " | " | 20 s | $H_2SO_4$ | 3% | " | " | " |
| 6 | | " | " | " | " | 15% | " | " | " |
| 7 | | " | " | " | " | " | " | 15 s | " |
| 8 | | " | " | " | HCl | 3% | " | 5 s | " |
| 9 | | " | " | " | " | 15% | " | " | " |
| 10 | | " | " | " | " | " | " | 15 s | " |
| 11 | NaOH | 3% | 80° C. | 3 s | $H_2SO_4$ | 3% | 80° C. | 2 s | 5 |
| 12 | | " | " | " | HCl | " | " | " | " |
| 13 | | 7% | " | 6 s | " | 8% | " | 5 s | " |
| 14 | | 15% | " | 3 s | " | " | " | " | " |
| 15 | | " | " | 20 s | $H_2SO_4$ | 3% | " | " | " |
| 16 | | " | " | " | " | 15% | " | " | " |
| 17 | | " | " | " | " | " | " | 15 s | " |
| 18 | | " | " | " | HCl | 3% | " | 5 s | " |
| 19 | | " | " | " | " | 15% | " | " | " |
| 20 | | " | " | " | " | " | " | 15 s | " |

TABLE 2

Effect of Plating Conditions on Plating Adhesion

| Run No. | Plating Bath Composition $ZnSO_4$ (g/l) | $ZnCl_2$ (g/l) | Additive (g/l) | Plating Conditions pH | Temp. (°C.) | Current Density | Speed (m/s) | Plating Adhesion (Rating) |
|---|---|---|---|---|---|---|---|---|
| 1 | 250 | — | — | 1.0 | 55 | 50 A/dm$^2$ | 1.0 | 5 |
| 2 | " | — | — | 1.8 | 45 | " | " | " |
| 3 | " | — | — | " | 55 | 10 A/dm$^2$ | " | " |
| 4 | " | — | — | " | " | 50 A/dm$^2$ | 0.6 | " |
| 5 | " | — | — | " | " | " | 1.0 | " |
| 6 | " | — | — | " | " | 100 A/dm$^2$ | " | " |
| 7 | " | — | — | " | 65 | 50 A/dm$^2$ | " | " |
| 8 | " | — | — | 2.4 | 55 | " | " | " |
| 9 | — | 200 | — | 1.0 | " | " | " | " |
| 10 | — | " | — | 1.8 | 45 | " | " | " |
| 11 | — | " | — | " | 55 | 10 A/dm$^2$ | " | " |
| 12 | — | " | — | " | " | 50 A/dm$^2$ | 0.6 | " |
| 13 | — | " | — | " | " | " | 1.0 | " |
| 14 | — | " | — | " | " | 100 A/dm$^2$ | " | " |
| 15 | — | " | — | " | 65 | 50 A/dm$^2$ | " | " |
| 16 | — | " | — | 2.4 | 55 | " | " | " |
| 17 | 75 | — | $NiSO_4$ 165 | 1.8 | " | " | " | 1 |
| 18 | — | 60 | $NiCl_2$ 140 | " | " | " | " | 1 |
| 19 | 100 | — | $FeSO_4$ 110 | " | " | " | " | 1 |
| 20 | — | 85 | $FeCl_2$ 90 | " | " | " | " | 1 |

TABLE 3

Effect of $Ni^{2+}$ ions on Plating Adhesion

| Run No. | Composition of Plating Bath $ZnSO_4$ (g/l) | $NiSO_4$ (g/l) | $ZnCl_2$ (g/l) | $NiCl_2$ (g/l) | $Ni^{2+}$ conc. in plating bath (g/l) | Plating Adhesion (Rating) |
|---|---|---|---|---|---|---|
| 1 | 250 | 10 | — | — | 3.8 | 4 |
| 2 | " | 20 | — | — | 7.6 | 3 |
| 3 | " | 30 | — | — | 11 | 2 |
| 4 | " | 60 | — | — | 23 | 1 |
| 5 | 125 | " | — | — | " | 1 |
| 6 | 75 | " | — | — | " | 1 |
| 7 | " | 165 | — | — | 63 | 1 |
| 8 | " | 200 | — | — | 76 | 1 |
| 9 | " | 220 | — | — | 83 | 2 |
| 10 | — | — | 200 | 10 | 4.5 | 4 |
| 11 | — | — | " | 20 | 9.1 | 3 |
| 12 | — | — | " | 30 | 14 | 2 |
| 13 | — | — | " | 60 | 27 | 1 |
| 14 | — | — | 100 | " | " | 1 |
| 15 | — | — | 60 | " | " | 1 |
| 16 | — | — | " | 140 | 63 | 1 |
| 17 | — | — | " | 170 | 77 | 1 |
| 18 | — | — | " | 200 | 91 | 1 |

TABLE 3-continued

Effect of $Ni^{2+}$ ions on Plating Adhesion

| Run No. | Composition of Plating Bath $ZnSO_4$ (g/l) | $NiSO_4$ (g/l) | $ZnCl_2$ (g/l) | $NiCl_2$ (g/l) | $Ni^{2+}$ conc. in plating bath (g/l) | Plating Adhesion (Rating) |
|---|---|---|---|---|---|---|
| 19 | — | — | " | 230 | 104 | 2 |

TABLE 4

Effect of $Fe^{2+}$ ions on Plating Adhesion

| Run No. | Composition of Plating Bath $ZnSO_4$ (g/l) | $FeSO_4$ (g/l) | $ZnCl_2$ (g/l) | $FeCl_2$ (g/l) | $Fe^{2+}$ conc. in plating bath (g/l) | Plating Adhesion (Rating) |
|---|---|---|---|---|---|---|
| 1 | 100 | 14 | — | — | 5 | 4 |
| 2 | " | 27 | — | — | 10 | 2 |
| 3 | " | 41 | — | — | 15 | 2 |
| 4 | " | 54 | — | — | 20 | 2 |
| 5 | " | 68 | — | — | 25 | 2 |
| 6 | " | 81 | — | — | 30 | 1 |
| 7 | " | 95 | — | — | 35 | 1 |

TABLE 4-continued

| Effect of $Fe^{2+}$ ions on Plating Adhesion | | | | | | |
|---|---|---|---|---|---|---|
| | Composition of Plating Bath | | | | $Fe^{2+}$ conc. in plating bath | Plating Adhesion |
| Run No. | $ZnSO_4$ (g/l) | $FeSO_4$ (g/l) | $ZnCl_2$ (g/l) | $FeCl_2$ (g/l) | (g/l) | (Rating) |
| 8 | " | 110 | — | — | 40 | 1 |
| 9 | " | 122 | — | — | 45 | 1 |
| 10 | — | — | 85 | 11 | 5 | 4 |
| 11 | — | — | " | 22 | 10 | 2 |
| 12 | — | — | " | 34 | 15 | 2 |
| 13 | — | — | " | 45 | 20 | 2 |
| 14 | — | — | " | 57 | 25 | 1 |
| 15 | — | — | " | 68 | 30 | 1 |
| 16 | — | — | " | 80 | 35 | 1 |
| 17 | — | — | " | 90 | 40 | 1 |
| 18 | — | — | " | 102 | 45 | 1 |

The mechanism of improvement in plating adhesion by addition of $Ni^{2+}$ or $Fe^{2+}$ ions is not clear, but it is believed that these ions are preferentially deposited in an early stage of electrodeposition, thereby causing the plating grains to have a refined and dense microstructure, which contributes to improvement in plating adhesion in deformed portions.

The minimum concentration of $Ni^{2+}$ or $Fe^{2+}$ ions in a plating bath required to attain good plating adhesion is about 10 g/l as $Ni^{2+}$ or $Fe^{2+}$ for both a sulfate and a chloride bath. A combination of $Ni^{2+}$ ions and $Fe^{2+}$ ions may be added to a plating bath. In such cases, the total concentration of $Ni^{2+}$ and $Fe^{2+}$ ions should be at least about 10 g/l. When these metal ions are present in a plating bath in a concentration of less than 10 g/l, the above-mentioned grain refinement effect and improvement in plating adhesion will not be attained sufficiently. Preferably the concentration of $Ni^{2+}$ and/or $Fe^{2+}$ ions is about 20 g/l or higher and more preferably about 30 g/l or higher in order to ensure that the adhesion of the resulting plated coating is improved in a stable manner. The maximum concentration of $Ni^{2+}$ and/or $Fe^{2+}$ ions is not limited to a particular value. With respect to $Ni^{2+}$ ions, however, it is preferred that the $Ni^{2+}$ concentration be on the order of 80 g/l or lower, since a higher $Ni^{2+}$ concentration causes the formation of a plated coating having an Ni content in excess of about 17% by weight, which is known to be stiff and brittle.

The zinc plating process of aluminum strip according to the present invention can be performed in a continuous manner using a continuous electroplating line which is similar to that employed in continuous zinc electroplating of steel strip and which has an alkaline degreasing zone, a pickling zone, and an acidic electroplating bath through which aluminum strip is passed sequentially.

The conditions for pretreatment, i.e., alkaline degreasing and pickling are not critical and may be the same as those conventionally employed for various plating processes. For example, the above-described conditions for these pretreating steps which are employed in pretreatment of steel strip can be used for aluminum strip. Thus, the alkaline degreasing may be performed by electrolysis in a dilute aqueous sodium orthosilicate or sodium hydroxide solution. The pickling may be conducted by means of immersion or spraying using a hydrochloric or sulfuric acid solution.

The aluminum strip which has been pretreated by alkaline degreasing and pickling is then subjected to electroplating in an acidic zinc plating bath containing, in addition to $Zn^{2+}$ ions, $Ni^{2+}$ and/or $Fe^{2+}$ ions in a concentration of at least about 10 g/l, preferably at least about 20 g/l, and most preferably at least about 30 g/l. The acidic plating bath may be either a sulfate bath or a chloride bath. Preferably the zinc electroplating is conducted under the following conditions: bath temperature of about 40°-70° C., current density of about 30-100 A/dm$^2$, and pH of about 1.0-2.5. The coating weight of the zinc electroplating is preferably at least about 1 g/m$^2$ and more preferably in the range of about 5-30 g/m$^2$. An electroplated coating of a Zn-Ni, Zn-Fe, or Zn-Ni-Fe alloy hereinafter collectively referred to as Zn-Ni/Fe alloy) is formed on the aluminum strip by the zinc electroplating.

The Zn-Ni/Fe alloy coating formed in accordance with the plating process of the present invention is known to have improved corrosion resistance and it also has improved applicability to chemical conversion treatment such as phosphating or chromating which is performed prior to finish paint coating. Therefore, the resulting electroplated aluminum strip is suitable for use in the manufacture of automobile bodies.

In some end uses, however, it may be desired that the electroplated aluminum strip have a plating surface of pure Zn metal, a Zn-Ni/Fe alloy having a particular composition, or another Zn alloy such as a Zn-Co alloy. For this purpose, the Zn-Ni/Fe electroplated coating may be overlaid with a second (upper) zinc electroplated coating having a different composition desired for the surface coating. In this case, a duplex zinc plated aluminum strip having a lower electroplated layer of a Zn-Ni/Fe alloy and an upper zinc or zinc alloy electroplated layer of a desired composition is produced. Thus, it is possible to readily prepared an electroplated aluminum strip having a desired surface composition of zinc or a zinc alloy in this manner.

In such a duplex plated aluminum strip, the lower Zn-Ni/Fe electroplated layer preferably has a coating weight in the range of about 0.7-10 g/m$^2$ and more preferably about 1-5 g/m$^2$. A lower Zn-Ni/Fe plating layer with a coating weight of less than about 0.7 g/m$^2$ is not sufficient to improve the plating adhesion satisfactorily. While a coating weight of more than about 10 g/m$^2$ does not adversely affect the plating adhesion, the coating weight of the lower plating layer should preferably be minimized so that the effects of the upper plating layer can be realized fully. The total coating weight of the duplex plating is preferably in the range of about 5-30 g/m$^2$.

The following examples are given to further illustrate the invention. In the examples, percents are by weight unless otherwise indicated.

EXAMPLE 1

A 0.8 mm-thick aluminum sheet made of an Al-4.5 Mg alloy suitable for use in the manufacture of automobile hoods was subjected to pretreatment in the following manner prior to zinc electroplating.

(1) Alkaline degreasing: Cathodic electrolysis for 6 seconds in an aqueous 7% sodium orthosilicate solution at 80° C.

(2) Rinsing with water.

(3) Pickling: dipping for 5 seconds in a 8% hydrochloric acid solution at 80° C.

(4) Rinsing with water.

The pretreated aluminum sheet was then subjected to zinc electroplating under the conditions shown in Table 5. In some runs, the electroplated aluminum sheet was further subjected to a second zinc electroplating to form an upper plating layer having a different composition as shown in Table 5. All the electroplating procedures were conducted by passing an aluminum sheet at a speed of 30 m/min through a sulfate bath at 55° C. The current density was 50 A/dm$^2$ and the bath pH was 1.8.

The resulting zinc-plated aluminum sheet was evaluated for adhesion of the plated coating to the aluminum substrate by the above-described testing method comprising an Erichsen cupping test to a depth of 7 mm followed by a pressure-sensitive adhesive tape peeling test. The test results are also given in Table 5.

As can been seen from Table 5, none of the zinc-plated aluminum sheets obtained in comparative runs had good adhesion (Ratings 3, 4, or 5 were assigned thereto). In contrast, each of the zinc-plated aluminum sheets according to the invention had excellent adhesion (Rating 1).

In the zinc-plated aluminum sheets according to the present invention, the Ni content of the lower plated coating was 2.8% in Runs Nos. 5 to 7 and 12.3% in Runs Nos. 8 and 9. The Ni content of the upper plated coating in Run No. 6 was 12.8% and the Fe content of the upper plated coating in Run No. 7 was 16.5%.

EXAMPLE 2

A 0.8 mm-thick Al-4.5 Mg aluminum alloy sheet was pretreated in the same manner as described in Example 1 and then subjected to zinc electroplating to a coating weight of 20 g/m$^2$ under the conditions shown in Table 6. The plating adhesion was evaluated in the same manner as in Example 1. The results are shown in Table 6.

The plating adhesion was significantly improved to a satisfactory level by the addition of $Fe^{2+}$ ions to a zinc plating bath in accordance with the invention regardless of the current density and the speed at which the aluminum alloy sheet was passed through the bath. The resulting zinc-plated coating contained 15% Fe in each of Runs Nos. 5 to 8 according to the invention.

As described above, in accordance with a process of the invention, a zinc electroplated coating having good adhesion can be applied to aluminum strip with a high current density by the same electroplating process used for steel strip, i.e., a process comprising alkaline degreasing, rinsing, pickling, rinsing, and zinc electroplating in an acidic plating bath. Therefore, an already-installed zinc electroplating line for steel strip can be used to apply zinc plating to aluminum strip by a process according to the invention. As a result, the invention makes it possible to manufacture zinc-plated aluminum strip suitable for use in automobile bodies in a continuous manner at a high speed on a large scale.

The surface composition of the resulting electroplated coating can be modified by applying an upper zinc electro-plating layer to form a duplex zinc plating so that the process finds wide applications. Even in such duplex electroplating, the overall process requires a much shorter period (shorter plating line and/or higher speed) than that required for a conventional displacement plating method.

The principles, preferred embodiments and modes of operation of the present invention have been described in the foregoing specification. The invention, however, is not to be construed as limited to the particular forms disclosed, since these are to be regarded as illustrative rather than restrictive. Variations and modifications may be made by those skilled in the art without departing from the concept of the invention.

What is claimed is:

1. A process for direct zinc electroplating of aluminum strip comprising continuously pretreating aluminum strip by alkaline degreasing and then pickling and subjecting the pretreated aluminum strip to zinc electroplating in an acidic zinc plating bath which contains, in addition to $Zn^{2+}$ ions, metal ions selected from the group consisting of $Ni^{2+}$ ions and $Fe^{2+}$ ions in a concentration of at least about 10 g/l to form a Zn-Ni, Zn-Fe, or Zn-Ni-Fe alloy plated coating, the electroplating being performed in a sulfate or chloride bath at a temperature of about 40°–70° C. and a pH of about 1.0–2.5 with a current density of about 30–100 A/dm$^2$.

TABLE 5

Results of Example 1

| Run No. | Lower Plating $Zn^{2+}$ (g/l) | Lower Plating $Ni^{2+}$ (g/l) | Lower Plating Coating Weight (g/m$^2$) | Upper Plating $Zn^{2+}$ (g/l) | Upper Plating $Ni^{2+}$ (g/l) | Upper Plating $Fe^{2+}$ (g/l) | Upper Plating Coating Weight (g/m$^2$) | Plating Adhesion (Rating) |
|---|---|---|---|---|---|---|---|---|
| | | | Comparative | | | | | |
| 1 | 90 | | 20 | | | | | 3 |
| 2 | 90 | 3 | 20 | | | | | 3 |
| 3 | 90 | 3 | 1 | 90 | | | 20 | 3 |
| 4 | 90 | 11 | 0.5 | 90 | | | 20 | 2 |
| | | | This Invention | | | | | |
| 5 | 90 | 11 | 1.2 | 90 | | | 20 | 1 |
| 6 | 90 | 11 | 1.2 | 30 | 61 | | 20 | 1 |
| 7 | 90 | 11 | 1.2 | 45 | | 50 | 20 | 1 |
| 8 | 30 | 61 | 1.2 | 90 | | | 20 | 1 |
| 9 | 30 | 61 | 20 | | | | | |

TABLE 6

Results of Example 2

| Run No. | $Fe^{2+}$ Conc. (g/l) | Plating Bath (g/l) $ZnSO_4$ | Plating Bath (g/l) $FeSO_4$ | Current Density (A/dm$^2$) | Speed (m/s) | Plating Adhesion (Rating) |
|---|---|---|---|---|---|---|
| | | | Comparative | | | |
| 1 | 0 | 100 | 0 | 35 | 0.6 | 5 |
| 2 | 0 | 100 | 0 | 35 | 1.0 | 5 |
| 3 | 0 | 100 | 0 | 50 | 0.6 | 5 |
| 4 | 0 | 100 | 0 | 50 | 1.0 | 5 |
| | | | This Invention | | | |
| 5 | 40 | 100 | 110 | 35 | 0.6 | 1 |
| 6 | 40 | 100 | 110 | 35 | 1.0 | 1 |
| 7 | 40 | 100 | 110 | 50 | 0.6 | 1 |
| 8 | 40 | 100 | 110 | 50 | 1.0 | 1 |

2. The process of claim 1, wherein the aluminum strip is processed continuously using a continuous electroplating line having an alkaline degreasing zone, a pickling zone, and an acidic electroplating bath, the alkaline degreasing being performed by electrolysis in a dilute aqueous sodium orthosilicate or sodium hydroxide solution.

3. The process of claim 1, wherein the acidic zinc plating bath contains the metal ions in a concentration of at least about 20 g/l.

4. The process of claim 3, wherein the plating bath contains about 30–80 g/l of $Ni^{2+}$ ions or at least about 30 g/l of $Fe^{2+}$ ions.

5. The process of claim 1, wherein the plated coating has a coating weight of at least about 1 $g/m^2$.

6. The process of claim 5, wherein the coating weight is about 5–30 $g/m^2$.

7. The process of claim 1, which further comprises subjecting the electroplated aluminum strip to a second zinc electroplating so as to form an upper zinc plated coating having a composition different from that formed in the first electroplating.

8. A process for direct zinc electroplating of aluminum strip comprising continuously pretreating aluminum strip by alkaline degreasing and then pickling, subjecting the pretreated aluminum strip to a first zinc electroplating in an acidic zinc plating bath which contains, in addition to $Zn^{2+}$ ions, metal ions selected from the group consisting of $Ni^{2+}$ ions and $Fe^{2+}$ ions in a concentration of at least about 10 g/l to form a lower plating layer of a Zn-Ni, Zn-Fe, or Zn-Ni-Fe alloy having a coating weight of about 0.7–10 $g/m^2$, and subjecting the aluminum strip to a second zinc electroplating in a separate electroplating bath to form an upper zinc plating layer having a composition different from the lower plated coating, each electroplating being performed in a sulfate or chloride bath at a temperature of about 40°–70° C. and a pH of about 1.0–2.5 with a current density of about 30–100 $A/dm^2$.

9. The process of claim 8, wherein the aluminum strip is processed continuously using a continuous electroplating line having an alkaline degreasing zone, a pickling zone, and first and second acidic electroplating baths.

10. The process of claim 8, wherein the alkaline degreasing is performed by electrolysis in a dilute aqueous sodium orthosilicate or sodium hydroxide solution.

11. The process of claim 8, wherein the plating bath used in the first electroplating contains the metal ions in a concentration of at least about 20 g/l.

12. The process of claim 11, wherein the plating bath contains about 30–80 g/l of $Ni^{2+}$ ions or at least about 30 g/l of $Fe^{2+}$ ions.

13. The process of claim 8, wherein the lower plating layer has a coating weight of about 1–5 $g/m^2$.

14. The process of claim 8, wherein the total coating weight of the lower and upper plating layers is about 5–30 $g/m^2$.

* * * * *